US008782890B2

(12) United States Patent
Verschaeve et al.

(10) Patent No.: US 8,782,890 B2
(45) Date of Patent: Jul. 22, 2014

(54) REGENERATOR FOR A THERMAL CYCLE ENGINE

(75) Inventors: Frank Verschaeve, Otegem (BE); Inge Schildermans, Marke (BE)

(73) Assignee: NV Bekaert SA, Zwevegem (BE)

( * ) Notice: Subject to any disclaimer, the term of this patent is extended or adjusted under 35 U.S.C. 154(b) by 365 days.

(21) Appl. No.: 13/255,461

(22) PCT Filed: Mar. 9, 2010

(86) PCT No.: PCT/EP2010/052955

§ 371 (c)(1),
(2), (4) Date: Sep. 8, 2011

(87) PCT Pub. No.: WO2010/108779

PCT Pub. Date: Sep. 30, 2010

(65) Prior Publication Data

US 2011/0315341 A1 Dec. 29, 2011

(30) Foreign Application Priority Data

Mar. 24, 2009 (EP) ..... 09155949

(51) Int. Cl.
*F01B 29/10* (2006.01)

(52) U.S. Cl.
USPC ..... 29/890.034; 165/4; 165/10; 29/890.03

(58) Field of Classification Search
USPC ..... 29/890.03, 890.034, 890.045, 890.211; 165/4, 10; 60/517, 521, 526
See application file for complete search history.

(56) References Cited

U.S. PATENT DOCUMENTS

| | | | | |
|---|---|---|---|---|
| 3,062,509 | A * | 11/1962 | Mulder | 165/10 |
| 3,379,000 | A | 4/1968 | Webber et al. | |
| 3,742,578 | A | 7/1973 | Dirne et al. | |
| 4,107,364 | A * | 8/1978 | Sisson | 428/196 |
| 4,209,563 | A * | 6/1980 | Sisson | 442/329 |
| 4,903,757 | A | 2/1990 | Berendt | |
| 6,003,320 | A | 12/1999 | Okamura et al. | |
| 6,591,609 | B2 * | 7/2003 | Kamen et al. | 60/526 |
| 6,862,883 | B2 * | 3/2005 | Kamen et al. | 60/526 |
| 7,089,735 | B1 * | 8/2006 | Qiu et al. | 60/517 |
| 7,137,251 | B2 * | 11/2006 | Qiu et al. | 60/521 |
| 7,219,712 | B2 * | 5/2007 | Qiu et al. | 165/10 |
| 2002/0029453 | A1 * | 3/2002 | Quick et al. | 29/423 |
| 2004/0003591 | A1 | 1/2004 | Kamen et al. | |
| 2011/0314789 | A1 | 12/2011 | Verschaeve | |

FOREIGN PATENT DOCUMENTS

| | | |
|---|---|---|
| DE | 1451156 | 2/1969 |
| DE | 102008029405 (A1) | 12/2009 |
| EP | 0 227 131 A1 | 7/1987 |
| EP | 0 764 488 A1 | 3/1997 |

(Continued)

OTHER PUBLICATIONS

Japanese Office Action, Application No. 2012-501231, Jan. 10, 2014, 8 pages.

(Continued)

*Primary Examiner* — David Bryant
*Assistant Examiner* — Jason L Vaughan
(74) *Attorney, Agent, or Firm* — Foley & Lardner LLP

(57) ABSTRACT

A regenerator (100), for a thermal cycle engine with external combustion, according to the invention comprises a network of metal fibers wherein a majority of the fibers at least partially encircles the axis of the regenerator. The fibers were part of a fiber bundle which is coiled and sintered thereby obtaining the regenerator.

14 Claims, 3 Drawing Sheets

(56) References Cited

FOREIGN PATENT DOCUMENTS

| | | | |
|---|---|---|---|
| EP | 1341630 (B1) | | 3/2009 |
| FR | 2615935 (A1) | | 12/1988 |
| GB | 747706 | | 4/1956 |
| JP | 49-21330 | B | 5/1974 |
| JP | 62-144942 | A | 6/1987 |
| JP | 1-240760 (A) | | 9/1989 |
| JP | 2-91463 (A) | | 3/1990 |
| JP | 3-83144 (A) | | 4/1991 |
| JP | 5-296590 (A) | | 9/1993 |
| JP | 8-28980 (A) | | 2/1996 |
| JP | 9-157783 | A | 6/1997 |
| JP | 2002-206816 | A | 7/2002 |
| JP | 2004-276113 | A | 10/2004 |
| JP | 2007-57230 | A | 3/2007 |
| WO | WO 98/25008 (A1) | | 6/1998 |
| WO | WO 01/65099 (A2) | | 9/2001 |
| WO | WO 02/057035 (A1) | | 7/2002 |

OTHER PUBLICATIONS

Japanese Office Action, Application No. 2012-501230, Jan. 24, 2014, 8 pages.

* cited by examiner

REGENERATOR FOR A THERMAL CYCLE ENGINE

TECHNICAL FIELD

The present invention relates to a regenerator for a thermal cycle engine with external combustion, such as a Stirling cycle heat engine. More in particular, the present invention relates to an improved regenerator for a thermal cycle engine.

The invention further relates to methods for obtaining such a regenerator and the use of such regenerator in a thermal cycle engine.

BACKGROUND ART

A regenerator is used in a thermal cycle machine to add and remove heat from the working fluid during different phases of the thermal cycle. Such regenerators must be capable of high heat transfer rates which typically suggests a high heat transfer area and low flow resistance to the working fluid.

Different types of regenerators are already available on the market. Typically such regenerators comprise metal screens, cylindrically wound wire gauze or 3D random fiber networks as e.g. described in JP1240760, JP2091463 and WO01/65099; or even short metal fibers as e.g. described in EP1341630.

A regenerator needs to have a very low thermal conductivity in the fluid flow direction; since one end of the regenerator is hot and the other end is cold. The regenerator also needs to have very high thermal conductivity in the direction normal to the fluid flow so that the working fluid can rapidly adjust itself to the local temperature inside the regenerator. The regenerator must also have a very large surface area to improve the rate of heat movement with the working fluid. Finally, the regenerator must have a low loss flow path, for the working fluid, so that minimal pressure drop will result as the working fluid moves through. In case the regenerator is made of fibers, the regenerator must be fabricated in such a manner as to prohibit fiber migration as fragments might be entrained in the working fluid and transported to the compression or expansion cylinders and result in damage to the piston seals.

Accordingly, this invention seeks to provide a new regenerator and method of making such a regenerator, which embodies the properties indicated above. Furthermore, this invention seeks to provide a regenerator which can be fitted into a stirling engine, using a minimum of adjustment.

DISCLOSURE OF INVENTION

Particular and preferred aspects of the invention are set out in the accompanying independent and dependent claims. Combinations of features from the dependent claims may be combined with features of the independent claims as appropriate and not merely as explicitly set out in the claims.

According to some embodiments of the present invention, at least 85% of the fibers in the regenerator at least partially encircle the axis.

The term "encircle" is to be understood as to pass around. Hence "a fiber which at least partially encircles the axis" means that the fiber at least partially passes around the axis. This may best be seen by projecting the fiber in the direction of the average flow path on a plane AA', being perpendicular to the average flow path. The projection line of the fiber, projected in the direction of the average flow path on a plane AA', being perpendicular to the average flow path, is not necessarily circular or to be an arc of a circle, having its centre coinciding with the projection of the axis on this plane AA'.

The best fitting line, i.e. the line which fits closest to the projection line of the fiber, projected in the direction of the average flow path on a plane AA', being perpendicular to the average flow path, has its concave side oriented to the projection of the axis on this plane AA'.

The regenerator, comprising fibers, which are optionally metal fibers, has a porosity P, which may range from 70% to 99%. This high porosity results in a high air permeability. This high air permeability for given fiber properties (such as mantle surface, equivalent diameter average cross section profile and the like) and for given regenerator properties, such as porosity, is particularly advantageous in case the regenerator is used to exchange heat in a thermal cycle engine, e.g. a Stirling cycle heat engine. This high air permeability results in a minimal pressure drop. Furthermore, the use of wound fiber bundles in the regenerator results in a 10% better thermal conductivity in the direction normal to the average flow direction of the working fluid.

According to some embodiments of the present invention, the regenerator may be cylindrical. The regenerator may optionally be conical, e.g. having circular or an elliptical cross section. For cylindrical regenerators, optionally the regenerator may be cylindrical with a circular or an elliptical cross section.

According to a first aspect of the present invention, a majority of fibers substantially encircles the axis of the regenerator. More in particular at least 85% of the fibers present in the regenerator substantially encircle the axis of the regenerator. According to the present invention, the fibers are part of a consolidated fiber structure, which is coiled about a coiling axis being substantially parallel to the average flow direction of the working fluid. The consolidated fiber structure may comprise at least one fiber bundle. The consolidated fiber structure may comprise at least one, optionally a plurality of identical or mutually different bundles, differing in type of fibers, fiber properties, such as fiber equivalent diameter or fiber material, or bundle properties such as bundle fineness. Preferably, the fibers bundles in the consolidated fiber structure are crimped. This increases the bulkiness of the fibers and of the fiber bundle. More preferably, the fiber bundles are supercrimped. The crimp wave is defined by R and S, wherein R is the distance between the top and the bottom of the crimp wave shape and S is the distance between two successive tops of the crimp wave shape. Supercrimped fiber bundles means that the crimp wave satisfies the following formulas: $3\ mm \leq R \leq \frac{1}{2}H$, wherein R is the distance between the top and the bottom of the crimp wave shape and H is the height of the regenerator; and $1\ mm \leq S \leq 4 \times R$, wherein S is the distance between two successive tops of the crimp wave shape. These supercrimped fibers provide a regenerator wherein the dominant fiber direction is axial which has a positive effect on the pressure drop over the regenerator. However, as the axial part of the fiber bundles will have a limited height, the axial dominant fiber direction will not have an effect on the heat conduction in axial direction.

According to the first aspect of the present invention, the regenerator can be in the form of a ring, as e.g. is used in a free piston Stirling cycle engine. The regenerator might also be in the form of a disc, as e.g. is used in an alpha type Stirling engine.

Any suitable type of metal or metal alloy may be used to provide the metal fibers. The metal fibers are for example made of steel such as stainless steel. Optionally stainless steel alloys are AISI 300 or AISI 400-serie alloys, such as AISI 316L or AISI 347, or alloys comprising Fe, Al and Cr, stainless steel comprising chromium, aluminium and/or nickel and 0.05 to 0.3% by weight of yttrium, cerium, lanthanum, hafnium or titanium, such as e.g. DIN1.4767 alloys or FeCrAlloy®, are used. Also copper or copper-alloys, or titanium or titanium alloys may be used. The metal fibers can also be made of nickel or a nickel alloy.

Metal fibers may be made by any presently known metal fiber production method, e.g. by bundle drawing operation as e.g. described in U.S. Pat. No. 3,379,000, by coil shaving operation as described in JP3083144, by wire shaving operations (such as steel wool) or by a method providing metal fibers from a bath of molten metal alloy. In order to provide the metal fibers with their average length, the metal fibers may be cut using the method as described in WO02/057035, or may be stretch broken.

Preferably the equivalent diameter D of the metal fibers is less than 100 μm such as less than 65 μm, more preferably less than 36 μm such as 35 μm, 22 μm or 17 μm. Optionally the equivalent diameter of the metal fibers is less than 15 μm, such as 14 μm, 12 μm or 11 μm, or even less than 9 μm such as e.g. 8 μm. Optionally the equivalent diameter D of the metal fibers is less than 7 μm or less than 6 μm, e.g. less than 5 μm, such as 1 μm, 1.5 μm, 2 μm, 3 μm, 3.5 μm, or 4 μm.

The metal fibers are preferably endless metal fibers, endless fibers being also known as filaments. Alternatively, the metal fibers may have an average fiber length Lfiber, optionally ranging from e.g. 4 cm to 30 cm. Preferably, the average fiber length Lfiber of the metal fibers is ranging from 5 cm to 25 cm.

The regenerator has a porosity ranging between 70% and 99%, more preferably the regenerator has a porosity ranging between 80 and 98%, most preferably the regenerator has a porosity ranging between 85 and 95%.

According to a second aspect of the present invention, a method to provide a regenerator is provided. This method for manufacturing a regenerator for a thermal cycle engine obtains a regenerator with an outer diameter. The method comprises the steps of:

- providing a consolidated fiber structure comprising fibers, the consolidated fiber structure having at least a leading edge;
- cylindrically winding said consolidated fiber structure, parallel to said leading edge, until the predetermined diameter, being said outer diameter of said regenerator, is obtained;
- providing a mesh having at least a mesh leading edge;
- cylindrically winding said mesh around said wound consolidated fiber structure, parallel to said mesh leading edge;
- sintering the wound consolidated fiber structure in such a manner as to cross-link the fibers at points of close contact between said fibers;
- removing said mesh from around the sintered regenerator.

According to an alternative second aspect of the present invention, a method to provide a regenerator is provided. This method for manufacturing a regenerator for a thermal cycle engine obtains a regenerator with an inner and an outer diameter. The method comprises the steps of:

- providing a consolidated fiber structure comprising fibers, the consolidated fiber structure having at least a leading edge;
- providing a reel, said reel having a diameter almost equal to the internal diameter of said regenerator;
- cylindrically winding said consolidated fiber structure onto said reel, parallel to said leading edge, until the predetermined diameter, being said outer diameter of said regenerator, is obtained;
- providing a mesh having at least a mesh leading edge;
- cylindrically winding said mesh around said wound consolidated fiber structure, parallel to said mesh leading edge, thereby obtaining a wound fiber structure within a sintering mal which is provided by said reel and said mesh;
- sintering the wound consolidated fiber structure in such a manner as to cross-link the fibers at points of close contact between said fibers;
- removing said mesh and said reel from around the sintered regenerator.

The mesh used as part of the sintering mal can also be replaced by a foil or plate, suitable for use in sintering. Preferably, the mesh, foil or plate, and the reel, if present, were subjected to a treatment which prevents that the mesh, foil or plate, nor the reel are sintered onto the regenerator.

In another preferred embodiment, the reel can be replaced by part of the cylinder head or an engine part, around which the regenerator is produced and which is not removed after the sintering step.

As such a regenerator is provided defining a regenerator volume filled with fiber material. Due to the use of the long fibers, combined with the winding operation, no fiber migration will occur. This also makes the use of meshes at the in and outflow sides of the regenerator obsolete.

Preferably, the sintering is a soft sintering, which allows the regenerator to be fit into the thermal cycle engine in an easy way, e.g. by pressing, without the need for a machining step.

Preferably, the regenerator is produced with an outer diameter being slightly bigger than the space available in the thermal cycle engine, which provides a tension between the soft sintered regenerator and the thermal cycle engine. This tension provides a seamless filling of the regenerator space in the thermal cycle engine, thereby avoiding preferential airflows which would otherwise occur at places where no or less fibers are available. The same reasoning goes for the inner diameter of the regenerator, when present.

The regenerator comprises fibers of which a majority of the fibers, such as at least 85%, at least partially encircle the axis, according to the first aspect of the present invention.

Particular and preferred aspects of the invention are set out in the accompanying independent and dependent claims. Features from the dependent claims may be combined with features of the independent claims and with features of other dependent claims as appropriate and not merely as explicitly set out in the claims.

The teachings of the present invention permit the design of improved regenerators for use in thermal cycle engines, e.g. stirling engines. The reduced pressure drop over the regenerator, due to the increased air permeability, causes a low loss flow path for the working fluid. By the use of fibers and their use in a regenerator with porosities of 70% to 99%, a large surface area is obtained. This large surface area improves the rate of heat movement with the working fluid. Furthermore, the use of wound fiber bundles in the regenerator results in a 10% better thermal conductivity in the direction normal to the average flow direction of the working fluid.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DEFINITIONS

The term "porosity" P is to be understood as $P=100*(1-d)$ wherein $d=(\text{weight of } 1\ m^3 \text{ sintered metal fiber medium})/(SF)$ wherein S F=specific weight per $m^3$ of alloy out of which the metal fibers of the sintered metal fiber medium are provided.

The "Air permeability" (also referred to as AP) is measured using the apparatuses as described in NF 95-352, being the equivalent of ISO 4002.

The term "equivalent diameter" of a particular fiber is to be understood as the diameter of an imaginary fiber having a circular radial cross section, which cross section having a surface area identical to the average of the surface areas of cross sections of the particular fiber.

The term "soft sintering" is to be understood as a sintering wherein the temperatures used are 20 to 100° C. lower than in a normal sintering process, in order to achieve a product wherein the fibers are bonded to each other at points of close contact, but wherein the product has still some flexibility and deformability.

BRIEF DESCRIPTION OF DRAWINGS

Example embodiments of the invention are described hereinafter with reference to the accompanying drawings in which.

Figure 1A:
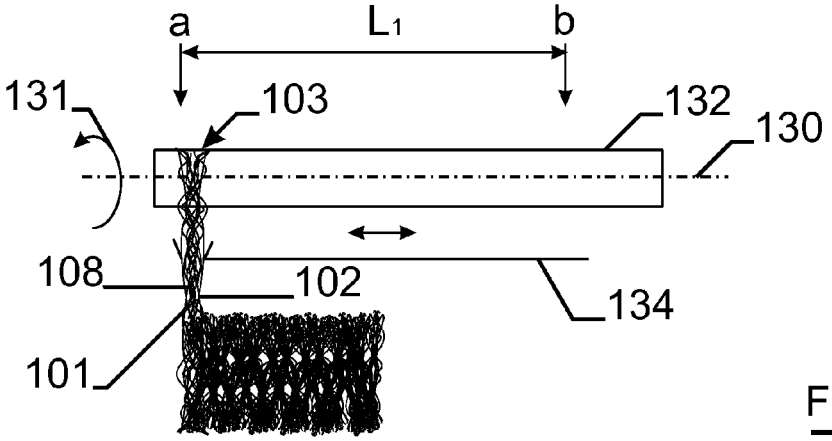
FIGS. 1*a* and 1*b* show schematically some of the consecutive steps of a method to provide a regenerator according to an aspect of the present invention.

In the different figures, the same reference signs refer to the same or analogous elements.

MODE(S) FOR CARRYING OUT THE INVENTION

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Figure 1B:
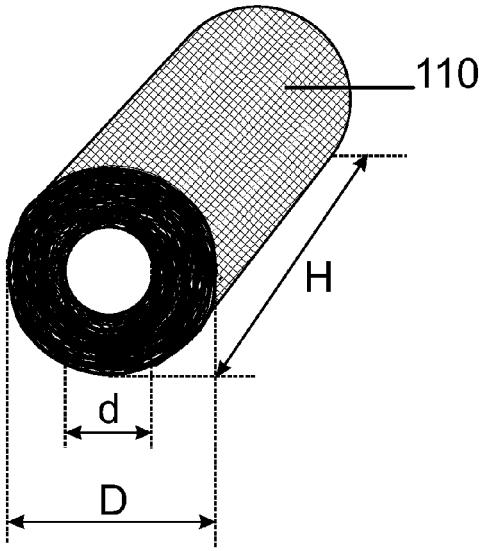

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein. Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein Some consecutive steps to provide a regenerator according to the second aspect of the present invention are shown in FIGS. 1*a* and 1*b*. As shown in a first step in FIG. 1*a*, a consolidated fiber structure 101 is provided, which structure 101 comprises a bundle 108 of fibers 102. The consolidated fiber structure 101 has a leading edge 103.

The bundle 108 comprises coil shaved or bundle drawn metal fibers having any suitable equivalent diameter e.g. 35 μm or 22 μm. The bundle has a fineness of typically 3 g/m. In case bundles of bundle drawn metal fibers are used, optionally the fibers in the bundle are provided with a crimp to increase the bulkiness of the fibers, hence of the bundle. This crimp can be applied before or after the leaching step after the bundled drawing of the metal fibers as described in U.S. Pat. No. 3,379,000. Preferably, the crimp is applied after the leaching step.

The fibers 102 in the consolidated fiber structure 101 are substantially oriented in parallel in the bundle 108. The consolidated fiber structure 101 is now wound or coiled about a reel 132, which reel defines a coiling axis 130, which coiling axis 130 is parallel to the leading edge 103. The winding is done according to a direction as indicated with arrow 131. The bundle 108 is wound around the reel 132 over a length L1. The bundle is guided by means of a reciprocating guiding means 134, guiding the bundle 108 between two extremes on the reel (indicated point a and b). The rotation of the reel and the reciprocating movement of the guiding means wind the bundle in e.g. a helix or spiral path around the reel 132.

By carefully defining the number of windings at a given position along the length of the shaft, the amount of fibers present at different locations can be determined and a homogeneous porosity can be obtained throughout the complete height H of the regenerator. The coiled fiber bundles are further surrounded by a mesh 110, as shown in FIG. 1*b*. Thereafter, the coiled fiber bundles 108, which are within a so-called sintering mal, being composed of the mesh 110 and the reel 132, are put in a sinter furnace for further consolidating the fiber structure. After the soft sintering operation the reel 132 and mesh 110 are removed and a fairly rigid but still flexible and highly porous regenerator 100 is obtained (not shown).

Figure 2A:
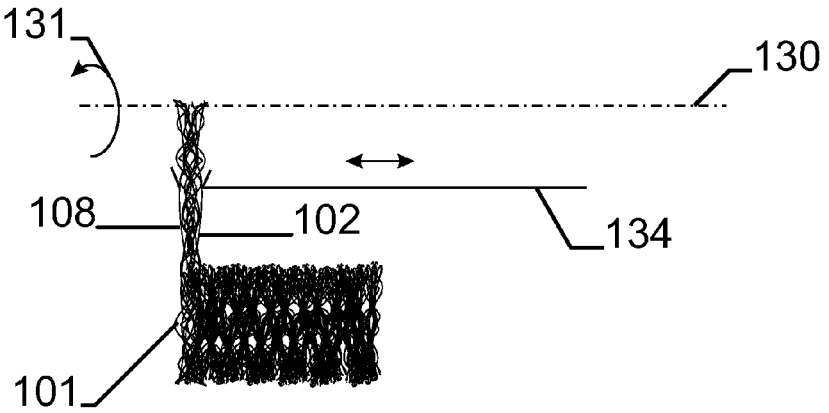
FIGS. 2*a* and 2*b* show schematically some of the consecutive steps of a method to provide an alternative regenerator according to an aspect of the present invention.
Figure 2B:
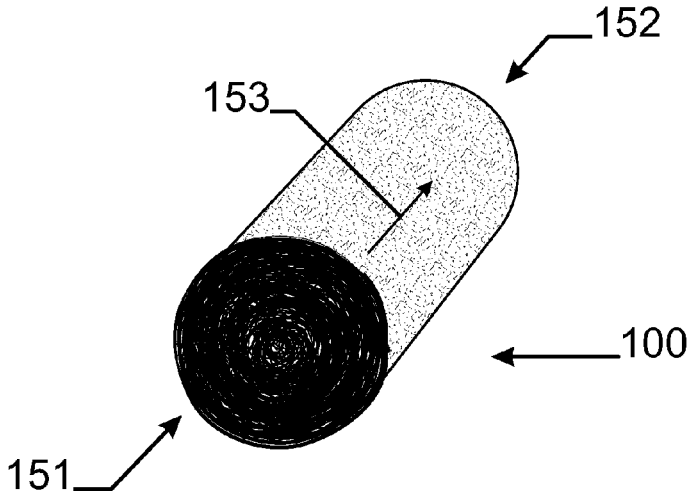

In a further exemplary embodiment, as shown in FIGS. 2*a* and 2*b*, a disc like wound fiber regenerator may be provided. As shown in a first step in FIG. 1*a*, a consolidated fiber structure 101 is provided, which structure 101 comprising a bundle 108 of fibers 102. The consolidated fiber structure 101 has a leading edge 103. The bundle 108 comprises coil shaved or bundle drawn metal fibers having any suitable equivalent diameter e.g. 35 μm or 22 μm. The bundle has a fineness of typically 3 g/m. In case bundles of bundle drawn metal fibers are used, optionally the fibers in the bundle are provided with a crimp to increase the bulkiness of the fibers, hence of the bundle.

The fibers 102 in the consolidated fiber structure 101 are substantially oriented in parallel in the bundle 108. The consolidated fiber structure 101 is now wound or coiled about a coiling axis 130, which coiling axis 130 is parallel to the leading edge 103. The winding is done according to a direction as indicated with arrow 131. The bundle 108 is further wound in the same way as described in FIG. 1, the bundle being guided by means of a reciprocating guiding means 134, guiding the bundle 108 between two extremes on the reel. The winding and the reciprocating movement of the guiding means wind the bundle in e.g. a helix or spiral path about the coiling axis 130.

By carefully defining the number of windings at a given position along the length of the shaft, the amount of fibers present at different location can be determined and a homogeneous porosity can be obtained throughout the complete height H of the regenerator. The coiled fiber bundles are further surrounded by a mesh 110, not shown. Thereafter, the coiled fiber bundles 108, which are within a so-called sintering mal, being composed of the mesh 110 only, are put in a sinter furnace for further consolidating the fiber structure. After the soft sintering operation the mesh 110 is removed and a fairly rigid but still flexible and highly porous regenerator 100 is obtained, as shown in FIG. 2*b*.

Figure 3:
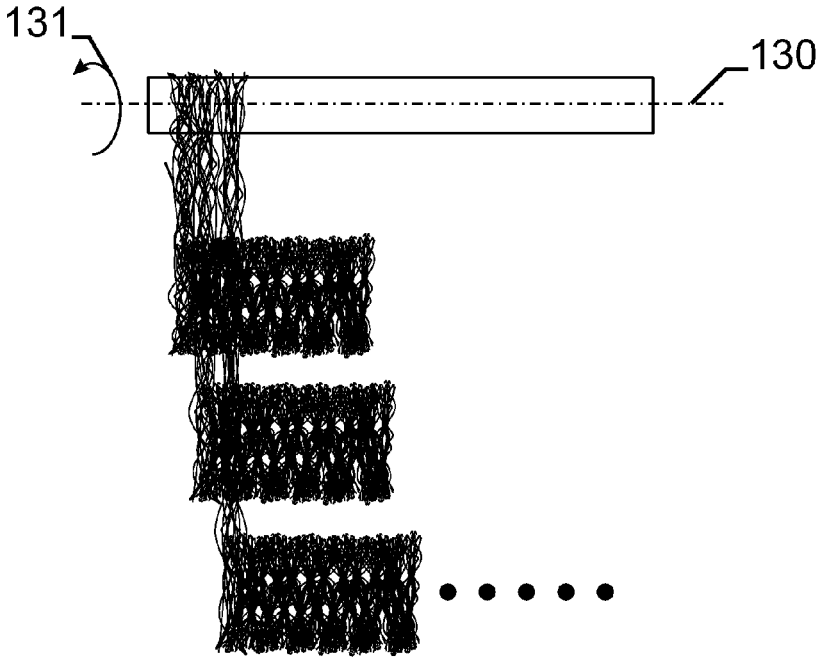
FIG. 3 shows a further alternative starting position for obtaining a regenerator according to the present invention.

FIG. 3 shows a further alternative starting position for the production of the regenerator according to the present invention. Here a multiple amount of fibre bundles are wound onto the reel, wherein those fibre bundles are all wound parallel to one another. The amount of fibre bundles used is dependent on the height H of the regenerator to be produced. When using this method for producing a regenerator according to the present invention, fiber bundles with differing metal compositions might be used, such that e.g. the hot side of the regenerator is made from fibers which are more heat resistant and the colder side of the regenerator is made from cheaper metal fibers which need not resist such high temperatures.

As will be explained further in detail, a majority of the fibers 102 (e.g. 85% or more) at least partially encircle the axis 130. This is because the fibers were present in the bundle in a direction parallel to the bundle. As the bundle 108 now is transformed into a spiral with axis 130, the fibers follow a path, which encircles at least partially the axis 130.

As such a regenerator 100 is provided with an inflow side 151 and an outflow side 152 defining an average flow direction 153, as depicted in FIG. 2*b*. The regenerator 100, being cylindrical, has its axis, which is identical to the coiling axis 130, substantially parallel to the average flow direction 153. The regenerator 100 has a height H. It is understood that the bundle 108 may be wound so as to provide a cylindrical regenerator. Some examples of regenerators according to the present invention are given in Table 1.

TABLE I

| exemplary regenerator | 1st | 2nd | 3rd | 4th |
|---|---|---|---|---|
| Outer diameter D in mm | 186 | 110 | 137 | 110 |
| Inner diameter d in mm | 131 | 86 | 103 | / |
| height H in mm | 33 | 58 | 32 | 58 |
| Porosity in % | 85 | 90 | 90 | 90 |
| type of fiber used | shaved | bundle drawn | bundle drawn | bundle drawn |
| Fiber Equivalent diameter in μm | 22 | 30 | 22 | 30 |

In a most preferable embodiment, the regenerator material can have a porosity of e.g. 85%, 86%, 87%, 88%, 89%, 90%, 91%, 92%, 93%, 94% or 95%.

As most of the fibers were present in the bundle 108 along the direction of the bundle, most of the fibers will at least partially encircle the axis 130. As the bundle is helically or spirally wound, the direction of the fibers may be provided with an axial component, hence most fibers will at least partially extend in the axial direction of the regenerator.

Figure 4:
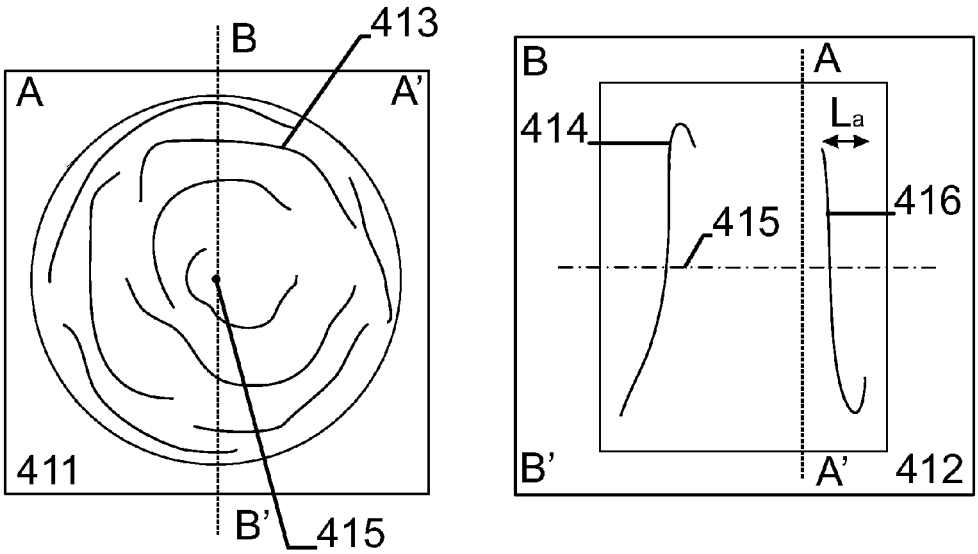
FIG. 4 shows views of the projections of fibers present in a regenerator according to the present invention.

FIG. 4 corresponds to regenerator 100 of FIG. 2*b*. 415 represents the projection of the axis 130. 411 in FIG. 4 shows schematically the projection line 413 of some fibers, projected in the direction of the average flow path on a plane AA', being perpendicular to the average flow path 153.

412 in FIG. 4 shows schematically the projection line 414 of some fibers, on a plane BB', comprising the average flow path projected in the direction perpendicular to this is plane BB'.

As is clear from 411, the projections of the fibers on a plane AA' show a path which at least partially encircles the projection 415 of the axis.

Hence, the fibers, which are projected on the plane AA', thus encircle the axis at least partially as well, seen in 3D. The concave side of the best fitting line is oriented to the projection 415.

As is clear from 412, the projections of the fibers on a plane BB' show a path which has a component extending in axial direction. As an example, the fiber which projection is 416, extends in axial direction along a length La.

Figure 5:
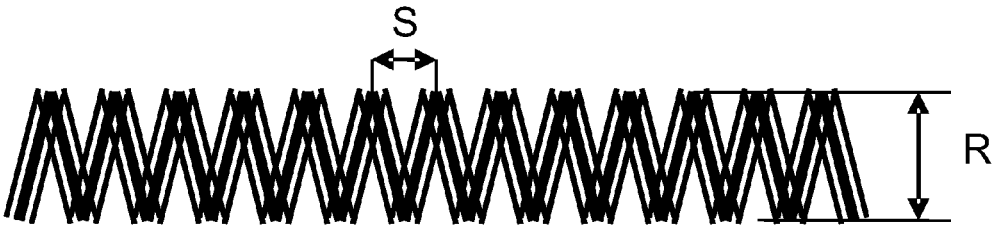
FIG. 5 shows an example of a supercrimped fiber bundle.

FIG. 5 shows an example of a supercrimped fiber bundle. The crimp wave is depicted wherein R is the distance between the top and the bottom of the crimp wave shape; and S is the distance between two successive tops of the crimp wave shape. These supercrimped fiber bundles can than be used in the method of FIG. 1*a*, FIG. 2*a* or FIG. 3.

Other arrangements for accomplishing the objectives of the methods and regenerators embodying the invention will be obvious for those skilled in the art. It is to be understood that although preferred embodiments, specific constructions and configurations, as well as materials, have been discussed herein for devices according to the present invention, various changes or modifications in form and detail may be made without departing from the scope of this invention as defined by the appended claims.

The invention claimed is:

1. A regenerator for a thermal cycle engine, the regenerator having an axis, said regenerator comprising a network of metal fibers wherein at least 85% of said fibers at least partially encircling said axis, wherein said metal fibers are part of fiber bundles which are supercrimped, said supercrimped fibers having a crimp wave satisfying the following formulas:

$3\ \text{mm} \le R \le \frac{1}{2}H$, wherein $R$ is the distance between the top and the bottom of the crimp wave shape and $H$ is the height of the regenerator; and $1\ \text{mm} \le S \le 4 \times R$, wherein $S$ is the distance between two successive tops of the crimp wave shape.

2. A regenerator according to claim 1, wherein at least one of said fiber bundles is coiled about said axis.

3. A regenerator according to claim 1, wherein said metal fibers are continuous metal fibers.

4. A regenerator according to claim 1, wherein said metal fibers have an average fiber length Lfiber ranging from 4 cm to 30 cm.

5. A regenerator according to claim 1, said fibers being mutually interconnected at points of close contact by a sinterbond.

6. A regenerator according to claim 1, wherein the porosity of said regenerator is in the range from 85 to 95%.

7. A regenerator according to claim 1, wherein said regenerator is in the form of a ring.

8. A regenerator according to claim 1, wherein said regenerator is in the form of a disc.

9. A method for manufacturing a regenerator for a thermal cycle engine, said regenerator having an outer diameter, the method comprising:

providing a consolidated fiber structure comprising metal fibers, the consolidated fiber structure having at least a leading edge;

cylindrically winding said consolidated fiber structure, parallel to said leading edge, until the predetermined diameter, being said outer diameter of said regenerator, is obtained;

providing a mesh having at least a mesh leading edge;

cylindrically winding said mesh around said wound consolidated fiber structure, parallel to said mesh leading edge;

sintering the wound consolidated fiber structure in such a manner as to cross-link the fibers at points of close contact between said fibers;

removing said mesh from around the sintered regenerator;

wherein at least 85% of said fibers at least partially encircling an axis of said regenerator, said fibers are part of fiber bundles which are supercrimped, and said supercrimped fibers having a crimp wave satisfying the following formulas:

$3\ \text{mm} \leq R \leq \frac{1}{2}H$, wherein $R$ is the distance between the top and the bottom of the crimp wave shape and $H$ is the height of the regenerator; and $1\ \text{mm} \leq S \leq 4 \times R$, wherein $S$ is the distance between two successive tops of the crimp wave shape.

10. A method for manufacturing a regenerator for a thermal cycle engine, said regenerator having an inner and an outer diameter, the method comprising:

providing a consolidated fiber structure comprising metal fibers, the consolidated fiber structure having at least a leading edge;

providing a reel, said reel having a diameter almost equal to the internal diameter of said regenerator;

cylindrically winding said consolidated fiber structure onto said reel, parallel to said leading edge, until the predetermined diameter, being said outer diameter of said regenerator, is obtained;

providing a mesh having at least a mesh leading edge;

cylindrically winding said mesh around said wound consolidated fiber structure, parallel to said mesh leading edge;

sintering the wound consolidated fiber structure in such a manner as to cross-link the fibers at points of close contact between said fibers;

removing said mesh and said reel from around the sintered regenerator;

wherein at least 85% of said fibers at least partially encircling an axis of said regenerator, said fibers are part of fiber bundles which are supercrimped, and said supercrimped fibers having a crimp wave satisfying the following formulas:

$3\ \text{mm} \leq R \leq \frac{1}{2}H$, wherein $R$ is the distance between the top and the bottom of the crimp wave shape and $H$ is the height of the regenerator; and $1\ \text{mm} \leq S \leq 4 \times R$, wherein $S$ is the distance between two successive tops of the crimp wave shape.

11. A method comprising:

contacting the regenerator as described in claim 1 and the working fluid of a thermal cycle engine with external combustion.

12. A method comprising:

contacting the regenerator as obtained in the method of claim 9 and the working fluid of a thermal cycle engine with external combustion.

13. A regenerator according to claim 2, wherein said metal fibers are continuous metal fibers.

14. A regenerator according to claim 2, wherein said metal fibers have an average fiber length Lfiber ranging from 4 cm to 30 cm.

* * * * *